United States Patent [19]

Mastrot et al.

[11] Patent Number: 4,735,070

[45] Date of Patent: Apr. 5, 1988

[54] METHOD AND APPARATUS FOR LUBRICATED FORWARD EXTRUSION WITH RADIAL FORWARD REMOVAL OF OUTER SHELL

[75] Inventors: Albert Mastrot, Saint Martin le Vinoux; Christian Pluchon; Jean-Mary Wattier, both of Voiron, all of France

[73] Assignee: Cegedur Societe de Transformation de l'Aluminium Pechiney, Paris, France

[21] Appl. No.: 858,745

[22] Filed: May 2, 1986

[30] Foreign Application Priority Data

May 2, 1985 [FR] France ..... 85 07240

[51] Int. Cl.[4] ..... B21C 43/00; B21C 23/00

[52] U.S. Cl. ..... 72/40; 72/254

[58] Field of Search ..... 72/254, 255, 253.1, 72/272, 40

[56] References Cited

U.S. PATENT DOCUMENTS

| | | | |
|---|---|---|---|
| 2,688,400 | 9/1954 | Ansel | 72/254 |
| 3,034,642 | 5/1962 | Graham | 72/255 |
| 3,736,786 | 6/1973 | Wagner | 72/255 |
| 4,208,897 | 6/1980 | Akeret | 72/254 |

FOREIGN PATENT DOCUMENTS

| | | | |
|---|---|---|---|
| 102312 | 8/1981 | Japan | 72/272 |
| 111522 | 9/1981 | Japan | 72/254 |
| 1235182 | 6/1971 | United Kingdom | 72/254 |
| 595032 | 2/1978 | U.S.S.R. | 72/254 |
| 904856 | 2/1982 | U.S.S.R. | 72/254 |

*Primary Examiner*—Lowell A. Larson

*Attorney, Agent, or Firm*—Dennison, Meserole, Pollack & Scheiner

[57] ABSTRACT

This invention relates to a method and an apparatus for lubricated forward extrusion of metals and alloys with radial forward removal of an outer shell or sheath. The method according to the invention consists of forming a gap in the form of a plane or slightly truncated cone-shaped circular outer ring having a constant thickness (j) and span (h) and open to the atmosphere between the end of the container adjacent to its bore and the assembly of extrusion tools situated opposite thereto. To facilitate the formation and especially the extraction of the outer shell, the extrusion apparatus comprises several knives situated in the above described gap, having their cutting edge directed towards the axis of the container and dividing the outer shell into as many "petals" in the course of extrusion.

8 Claims, 4 Drawing Sheets

Figure 1A:
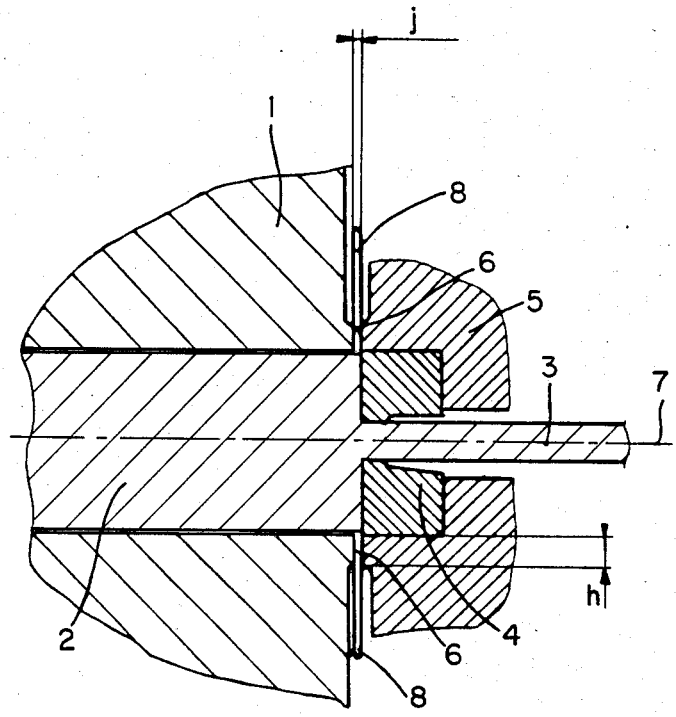

METHOD AND APPARATUS FOR LUBRICATED FORWARD EXTRUSION WITH RADIAL FORWARD REMOVAL OF OUTER SHELL

The present invention relates to a method and an apparatus for forward extrusion of metals and alloys with forward radial removal of outer shell.

Forward extrusion with axial forward removal of outer shell is known in the technical literature. It may be recalled that this consists of forcing a billet situated inside a metal container, generally a roughcast billet, through an assembly of extrusion tools generally comprising a die, counter-die and die stock by means of a ram. In the course of this extrusion, the outer part of the billet, known as the "shell" is removed by passing through an axial cylindrical gap between the container and the die stock.

Apparatus of this kind are described, for example, in Pat. DE-PS No. 271 378, DE-PS No. 1 127 305 and FR No. 1 536 990.

These known apparatus, however, all have the disadvantage that the outer shell thus formed accumulates inside a closed chamber which forms an intrinsic part of the extrusion apparatus and from which it can only be removed with great difficulty together with the slag at the end of the drawing or extrusion process.

The method according to the invention consists of providing a gap in the form of a circular ring which may be plane or slightly truncated cone shaped and has a constant thickness (j) and span (h) and is open to the atmosphere, between the end of the billet container adjacent to its bore and the surface of the extrusion tools situated opposite. It is through this gap that the shell flows substantially radially in the process of its formation from the outer zone of the extruded billet. When the gap is in the form of a truncated cone, the half angle at the apex of the cone is greater than or equal to 75°.

The values j and h are functions of a large number of operating parameters, such as the temperature of the billet, the nature of the alloy, the rate of extrusion, the length of the billet, the extrusion ratio, etc. but these values can easily be determined by the man of the art, either by calculation or by experimentation or by simulation (for example by means of plasticine).

To facilitate the formation and especially the extraction of the outer shell, the extrusion apparatus is equipped with several knives situated in the above-described gap and having their cutting edge directed to the axis of the billet container to divide the outer shell into as many "petals" in the course of the extrusion process. These knives are preferably arranged at equal angular intervals. They may consist of individual elements or they may form an integral part of a circular piece turned back from the end of the container or they may be directly formed in an extension of the end of the core of the container.

When the extrusion apparatus is in use, the billet and/or its container are preferably lubricated with conventional lubricants such as graphite lubricant, glass, etc. The lubricant should be completely removed from the external surface of the "petals" and no lubricant should be left on the extruded product.

Figure 1B:
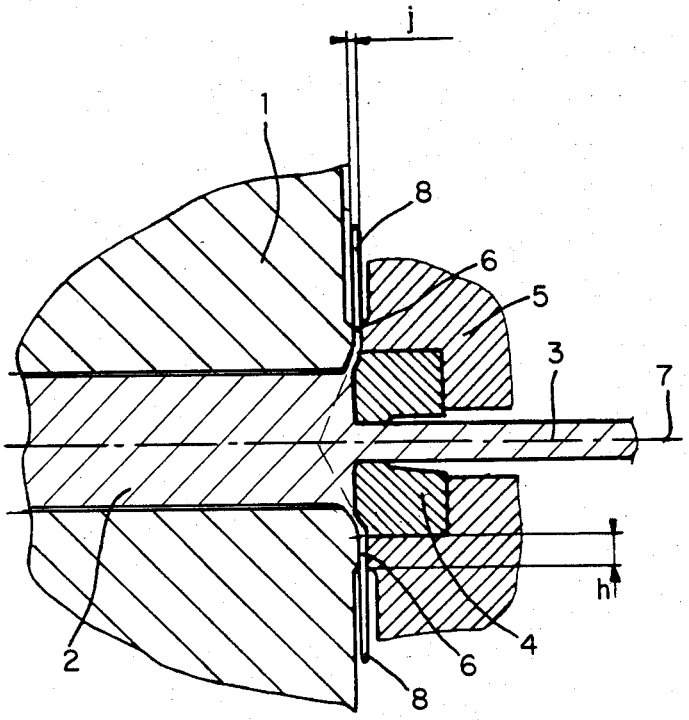
Figure 2B:
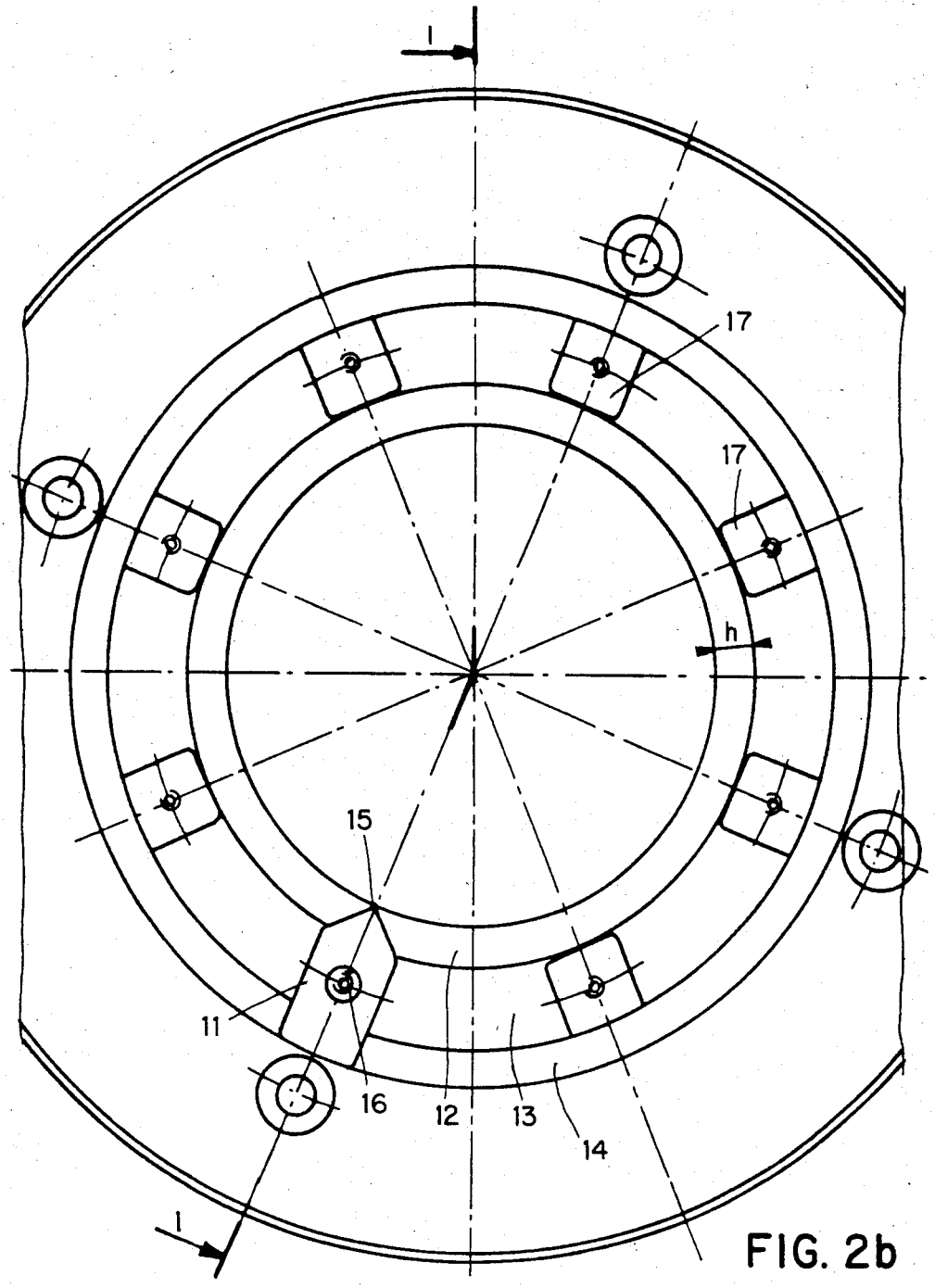
Figure 2A:
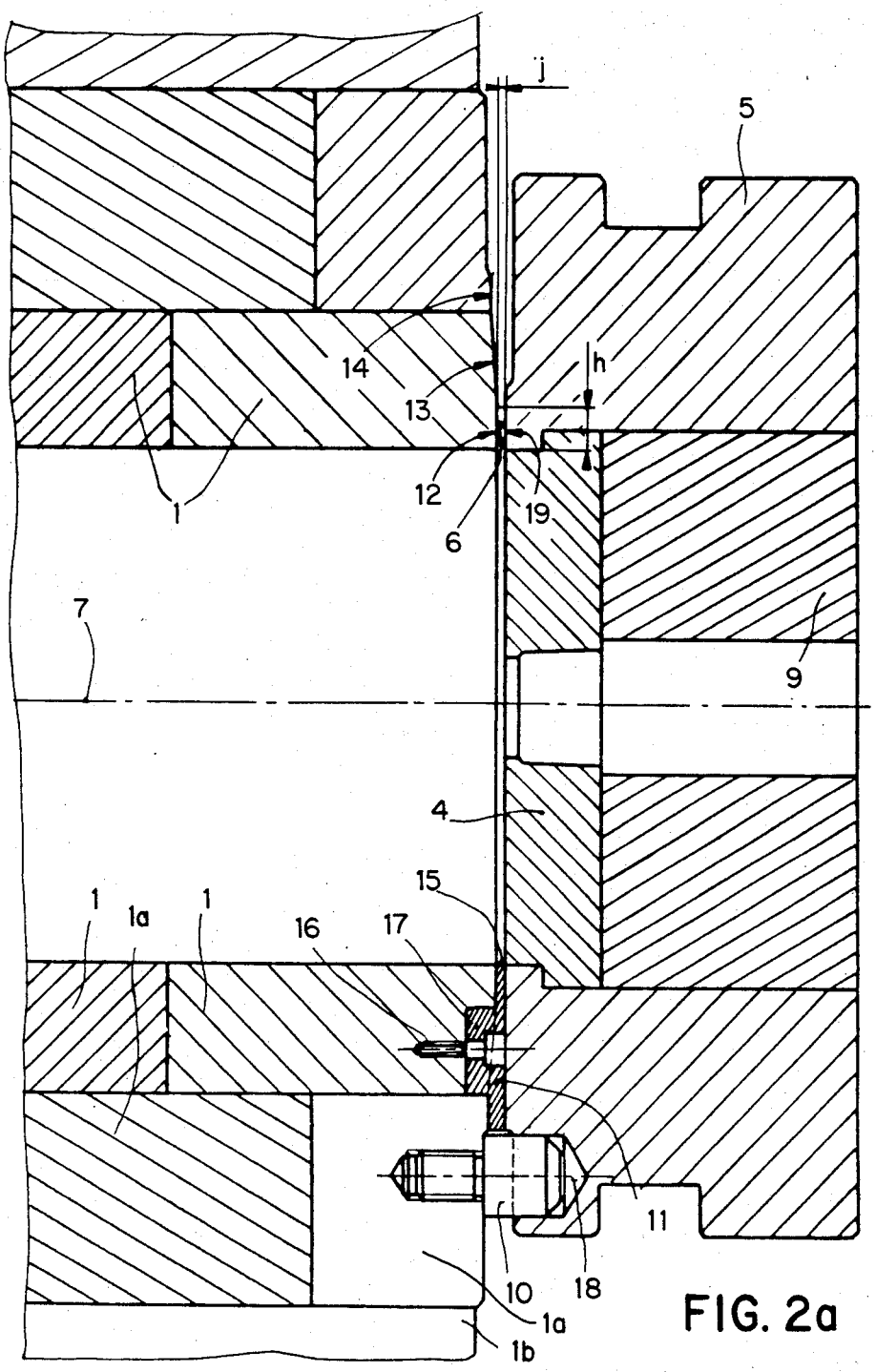

The invention will be more clearly understood with the aid of the following Figures and Examples:

FIG. 1*a* is a schematic representation of an apparatus according to the invention shown in axial section, FIG. 1*b* is a schematic representation of a variation of the apparatus shown in FIG. 1*a*, FIG. 2*a* represents an axial section through an apparatus according to the invention taken on the line I—I of FIG. 2*b*, and FIG. 2*b* represents an end view of the billet container with one of the knives in position.

FIGS. 1*a* and 1*b* show the container (1) of an extrusion press (not shown) in which a billet (2) is converted into an extruded product (3) by its passage through a die (4) inserted in a die stock (5).

A plane gap (6) of thickness (j) and circular sweep (h) is formed between the end of the container (1) and the die stock (5) in a direction perpendicular to the axis (7) of the press. The shell (8) is formed through this gap.

In FIG. 1*a*, gap 6 is substantially perpendicular to the axis of forward extrusion. In FIG. 1*b*, the angle between gap 6 and the axis of forward extrusion is slightly less than 90°, the gap being in the form of a truncated cone.

FIGS. 2 and 3 show a container (1) composed of a plurality of hooped parts (1*a*, 1*b*) and an assembly composed of the die (4), the die stock (5) and the counter die (9) all centered on the same axis (7), the front part of the container comprising a plane circular part (12) adjacent to its bore, a truncated cone-shaped surface (13) and a plane outer circular ring (14). The knives (11), which are anchored in this end, have their cutting edge (15) arranged parallel to the axis (7) and substantially at the level of the bore of the container.

The die stock (5) has a plane surface (19) which is situated opposite the plane surface (12) of the container to define the gap (6) of width (j) and span (h).

The knives are attached to the container by screws (16) in their respective seatings (17).

The apparatus also has centering pins (10) screwed into the container and engaging in corresponding cavities (18) of the die stock (5).

EXAMPLES

Billets of various alloys of aluminium were extruded into various forms in a LOEWY press equipped with $\phi$ 125 mm billet container, the billets having been lubricated with graphite lubricant before being extended out under the conditions summarized in Table I.

Four knives arranged at right angles to one another and made of treated steel (Z39CDVS5 according to AFNOR nomenclature) were inserted in the gap.

Products with a very good surface and free from extrusion lubricant were obtained from these apparatus at an extrusion pressure distinctly lower than that employed in conventional forward extrusion with rear removal of outer shell carried out under the same conditions.

The apparatus according to the invention also has the following additional advantages:

The removal of outer crust and/or surface cleaning of the billet before extrusion is obviated, products with a good surface and absolutely free from the lubricant used for extrusion are obtainable, the apparatus eliminates the main cause of appearance of air pockets on products extruded from aluminium or alloys, such air pockets, when they appear, being caused by oxides formed on the skin of the billet being carried in under the surface. This constitutes a considerable advantage compared with backward extrusion, for which axial removal of the outer shell constitutes a delicate operation, the extrusion pressures are close to those obtained in backward extrusion but at the same time extruded products with larger transverse dimensions can be obtained from the same container, the products obtained have a fine and homogeneous structure virtually free from a coarse grained cortical zone in the case of aluminium alloys, putting the process into operation or realizing the apparatus requires only minor modifications of existing forward extrusion presses, the thickness of the outer shell formed is virtually independepent of the centering of the extrusion tools in relation to the axis of the container, and lastly, when extruding sheathed billets, formed by fusion or powder metallurgy, the method and apparatus enable the sheath to be automatically eliminated.

TABLE I

| ALLOY* | 5086 | 2024 | | | 7075 | | | 6060 |
|---|---|---|---|---|---|---|---|---|
| Products (dimensions in mm) | 20 / 50 | 20 / 50 | 5 / 25 / 50 | Ø 30x6 | 20 / 50 | 5 / 25 / 50 | Ø 30x6 | Ø 25 |
| Drawing ratio | 12 | 12 | 27 | 31 | 12 | 27 | 31 | 25 |
| Gap | | | | | | | | |
| Clearance: j (mm) | 1 | 1 | 2 | 2 | 1 | 2 | 2 | 2 |
| Span: h (mm) | 10 | 10 | 10 | 10 | 10 | 10 | 10 | 10 |
| Length of billet (mm) | 285 | 360 | 260 | 260 | 350 | 260 | 260 | 100 |
| Temperature of billet (°C.) | | | | | | | | |
| (a) | 360 | 360 | 360 | 360 | 360 | 350 | 350 | 300 |
| (b) | 420 | 420 | 420 | 420 | 390 | 400 | 400 | 350 |
| Pressure peak (MPa) | | | | | | | | |
| (a) | 380 | 390 | 550 | 530 | 400 | 560 | 590 | 420 |
| (b) | 670 | 730 | 660 | 730 | 730 | 680 | 730 | 470 |
| Final extrusion pressure (MPa) | | | | | | | | |
| (a) | 320 | 320 | 480 | 460 | 330 | 490 | 510 | 350 |
| (b) | 270 | 260 | 440 | 440 | 290 | 250 | 420 | 350 |
| Extrusion rate of product (m/mn) | 12 | 2.5 | 1.8 | 5 | 1.5 | 1 | 2 | 10 |

*According to the definition of Aluminum Association
(a) According to the invention
(b) According to prior art forward extrusion

What is claimed is:

1. In an apparatus for forward extrusion of a metal billet with forward removal of an outer shell of said billet, with the aid of an extrusion press comprising at least one billet container having an axial bore and an assembly of extrusion tools, the improvement comprising means for providing a plane radial gap (6) at an angle of between about 75° and 90° with respect to the axis of forward extrusion, for removal of said outer shell, the gap being in the form of a circular ring of thickness (j) and span (h), the gap being open to the atmosphere and formed between a front surface (12) of the container (1) in the immediate vicinity of its bore and the assembly of extrusion tools (4, 5, 9) situated opposite thereto.

2. Apparatus according to claim 1, wherein detachable knives (11) are arranged in the gap (6), said knives having their cutting edges (15) directed towards the axis of the press (7).

3. Apparatus according to claim 2 wherein the knives are integral with a circular piece formed at the end of the container.

4. Apparatus according to claim 2 wherein the knives are formed directly on an extension of the core of the container.

5. Apparatus as in one of claims 2 to 4, wherein the knives are arranged at regular angular intervals.

6. A method of forward extrusion with forward removal of an outer shell, of a billet of metals and alloys, with the aid of an extrusion press comprising at least one billet container and an assembly of extrusion tools, comprising the steps of: providing a plane radial gap (6) at an angle of between about 75° and 90° with respect to the axis of forward extrusion, the gap being in the form of a circular ring of thickness (j) and span (h), open to the atmosphere, and formed between a front surface (12) of the container (1) in the immediate vicinity of its bore and assembly of extrusion tools (4, 5, 9) situated opposite thereto, and extruding the billet through the assembly of extrusion tools whereby forward radial removal of the outer shell is effected.

7. The method of claim 6 wherein the billet (2) and/or the container (1) are lubricated prior to the extrusion.

8. The method of claim 6 wherein during the extrusion of sheathed billets the sheath is eliminated in the course of extrusion.

* * * * *